US007476287B2

(12) United States Patent
Berg

(10) Patent No.: US 7,476,287 B2
(45) Date of Patent: Jan. 13, 2009

(54) SOLUBLE RIVET TAPE

(75) Inventor: Frederic P. Berg, Seattle, WA (US)

(73) Assignee: The Boeing Company, Chicago, IL (US)

( * ) Notice: Subject to any disclaimer, the term of this patent is extended or adjusted under 35 U.S.C. 154(b) by 378 days.

(21) Appl. No.: 11/155,709

(22) Filed: Jun. 17, 2005

(65) Prior Publication Data

US 2005/0230032 A1 Oct. 20, 2005

Related U.S. Application Data

(62) Division of application No. 10/304,638, filed on Nov. 26, 2002, now abandoned.

(51) Int. Cl.
*B32B 37/00* (2006.01)

(52) U.S. Cl. ..... 156/155; 156/91; 156/92; 156/247; 156/344

(58) Field of Classification Search ..... 156/155, 156/247, 91, 92, 344
See application file for complete search history.

(56) References Cited

U.S. PATENT DOCUMENTS 3,491,877 A * 1/1970 Viker et al. ..... 428/343
5,853,876 A * 12/1998 Takano et al. ..... 428/343

FOREIGN PATENT DOCUMENTS

| | | | |
|---|---|---|---|
| EP | 87306729 | | 7/1987 |
| JP | 56030481 A | | 8/1979 |
| JP | 7-145364 A | * | 6/1995 |
| JP | 7-145365 A | * | 6/1995 |
| JP | 10060390 A | | 8/1996 |

* cited by examiner

*Primary Examiner*—Jeff H Aftergut

(57) ABSTRACT

A soluble rivet tape is provided. The tape includes a soluble film and an adhesive coating that is applied to one or more sections of the soluble film. A plurality of rivets are inserted into place on a product, such as an airplane. The soluble rivet tape is applied to the product over the placed rivets. The plurality of rivets are set and the soluble rivet tape is removed. Any remaining rivet tape on the product is dissolved during a washing process.

13 Claims, 4 Drawing Sheets

SOLUBLE RIVET TAPE

PRIORITY CLAIM

This is a Divisional application based on U.S. application Ser. No. 10/304,638, filed Nov. 26, 2002, now abandoned, and incorporated herein by reference.

FIELD OF THE INVENTION

The present invention relates to rivets and, more particularly, to rivet tape.

BACKGROUND OF THE INVENTION

In large riveting jobs, such as aircraft manufacturing, where hundreds or thousands of rivets must be applied to a given surface, there is a great cost savings in making the riveting process as efficient as possible. Rivet tape was developed in order to hold rivets in place during these large riveting jobs, and thus allow a riveter to quickly perform hundreds upon hundreds of hand rivets.

Example rivet tapes presently used are 3M-695 (polyethylene) or 3M-685 (polyester) rivet tapes. These rivet tapes are polyethylene film tape with adhesive rubber or acrylic adhesive strips along the edges.

These rivet tapes do an adequate job of holding the rivets in place. However, tape particles from these rivet tapes frequently get caught under heads of the rivets. The tape particles that get caught are hard to see and are only visible after the aircraft has been painted. Painted over tape particles require sanding to ensure integrity of the aircraft skin. Repairing these defects can add great cost to aircraft production and maintenance.

Therefore, there is an unmet need to avoid paint defect problems that result from painted-over, entrapped rivet tape.

SUMMARY OF THE INVENTION

The present invention provides a soluble rivet tape. The tape includes a soluble film and an adhesive coating that is applied to one or more sections of the soluble film. A plurality of rivets are inserted into place on a product, such as an airplane. The soluble rivet tape is applied to the product over the placed rivets. The plurality of rivets are set and the soluble rivet tape is removed. Any remaining rivet tape on the product is dissolved during a washing process.

In an aspect of the invention, the soluble film is suitably an alkaline-soluble film or a polyvinyl alcohol film.

In an other aspect of the invention, the adhesive coating is suitably a rubber-based coating or an acrylic-based coating.

BRIEF DESCRIPTION OF THE DRAWINGS

The preferred and alternative embodiments of the present invention are described in detail below with reference to the following drawings.

DETAILED DESCRIPTION OF THE INVENTION

Figure 1:
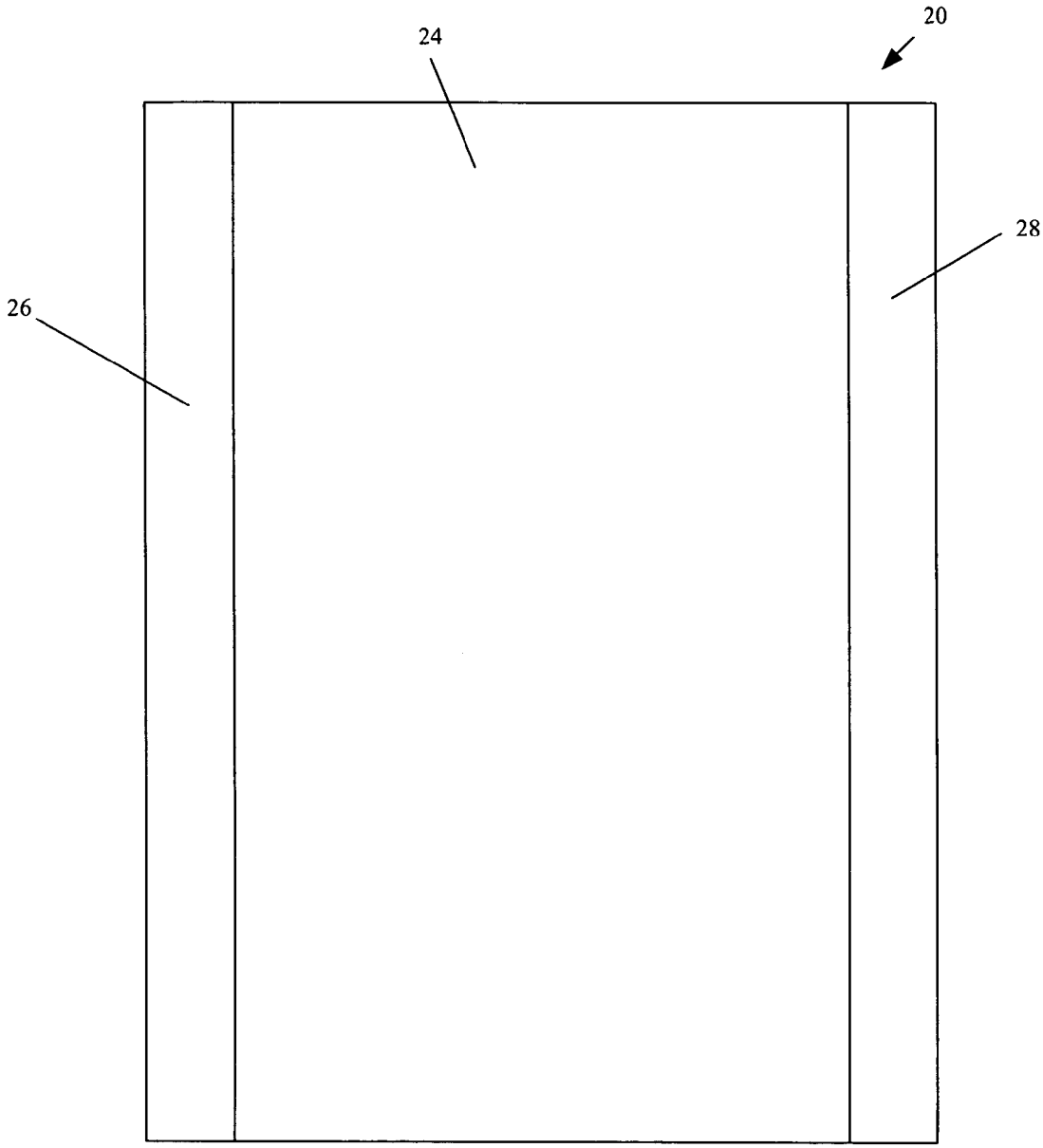
FIG. 1 illustrates a nonlimiting example piece of rivet tape formed in accordance with the present invention.

FIG. 1 illustrates a nonlimiting example piece of rivet tape 20 of the present invention. The rivet tape 20 includes a first non-adhesive section 24 that is framed by second and third adhesive sections 26 and 28. The second and third sections 26 and 28 are substantially parallel along a length-wise axis of the first section 24. The tape 20 is advantageously a water-soluble film, such as without limitation polyvinyl alcohol (PVA) film. The second and third sections 26 and 28 are coated with an adhesive on one side. The adhesive coating on the second and third sections 26 and 28 are suitable rubber-based or acrylic-based coatings. The tape 20 suitably comes in various sizes, such as without limitation, 1", 2" or 4½" variations or the like.

In one embodiment, the water-soluble film is less than about 0.002 inches thick. However, films of other thicknesses may be used as desired for a particular application. The water-soluble film is cold-or-hot water-soluble, depending upon the type of film used. Aquafilm and Monosol are manufacturers of example water-soluble films.

Figure 2:
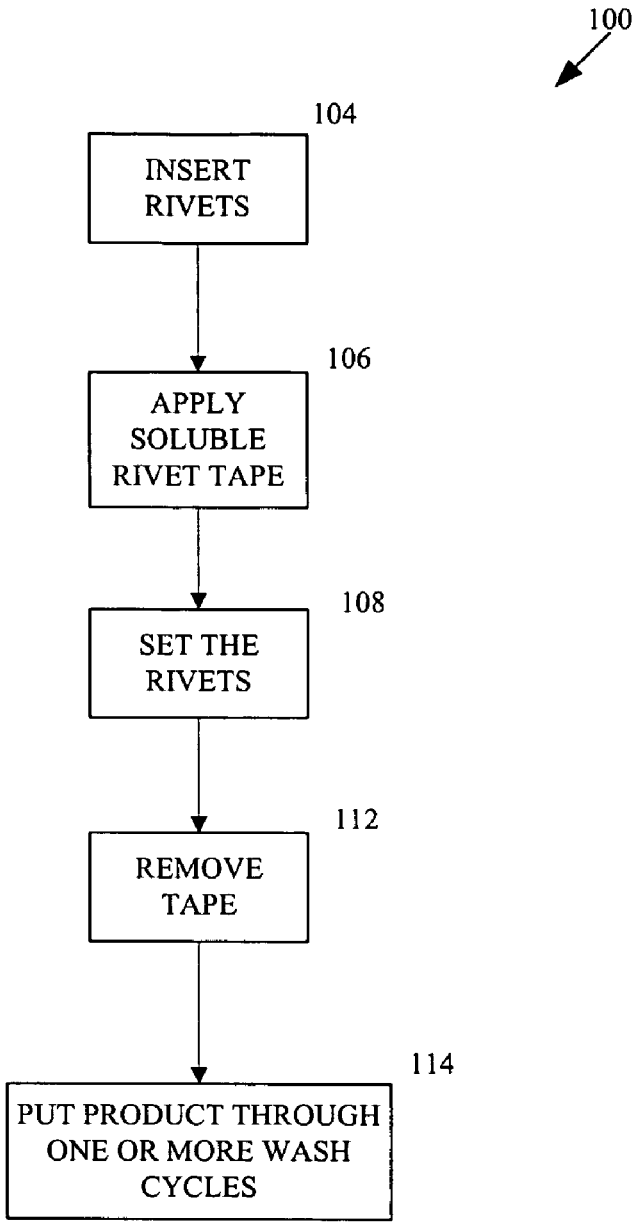
FIG. 2 illustrates a process for using the rivet tape shown in FIG. 1.
Figure 3:
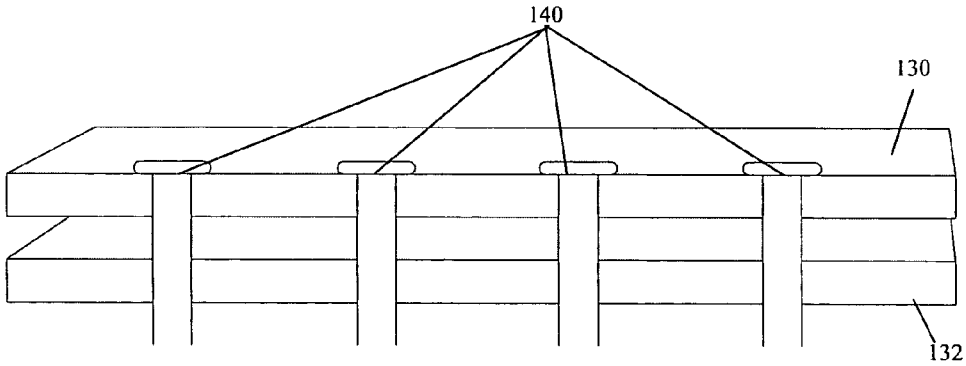
FIGS. 3-6 are illustrative examples of the process shown in FIG. 2.
Figure 4:
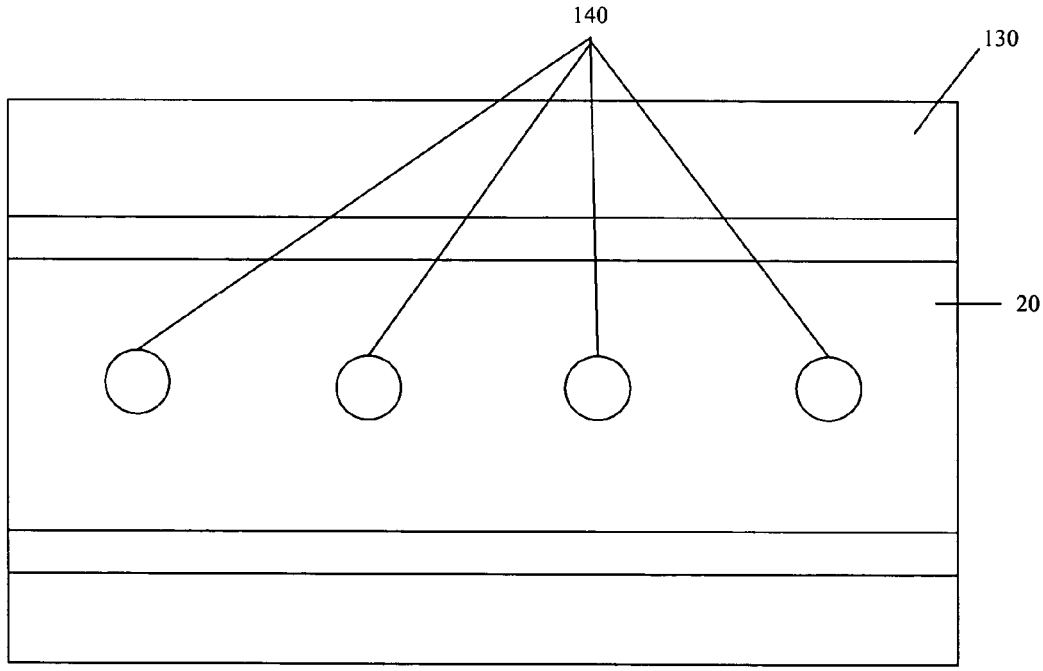
Figure 5:
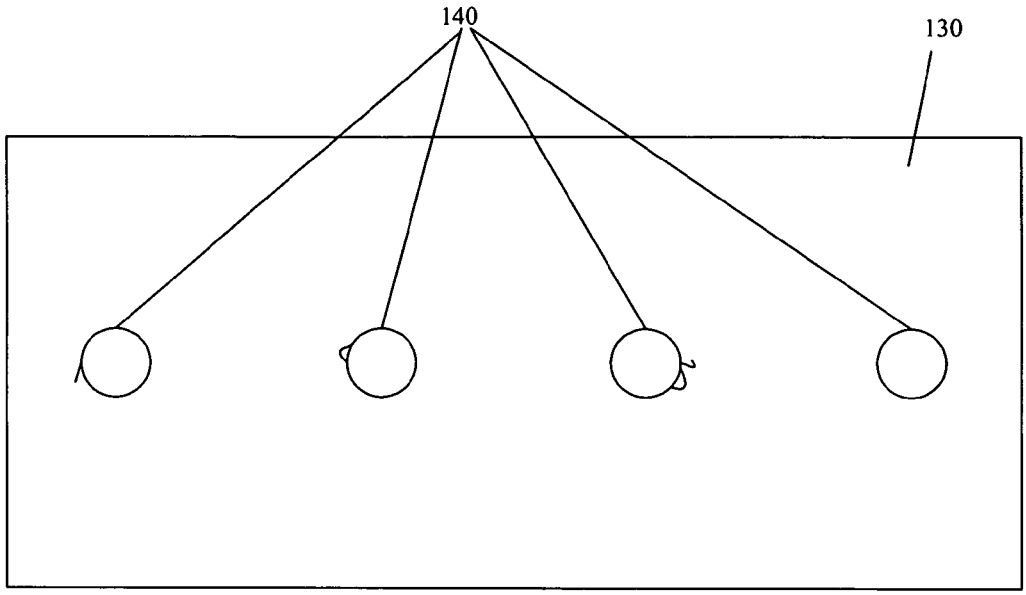
Figure 6:
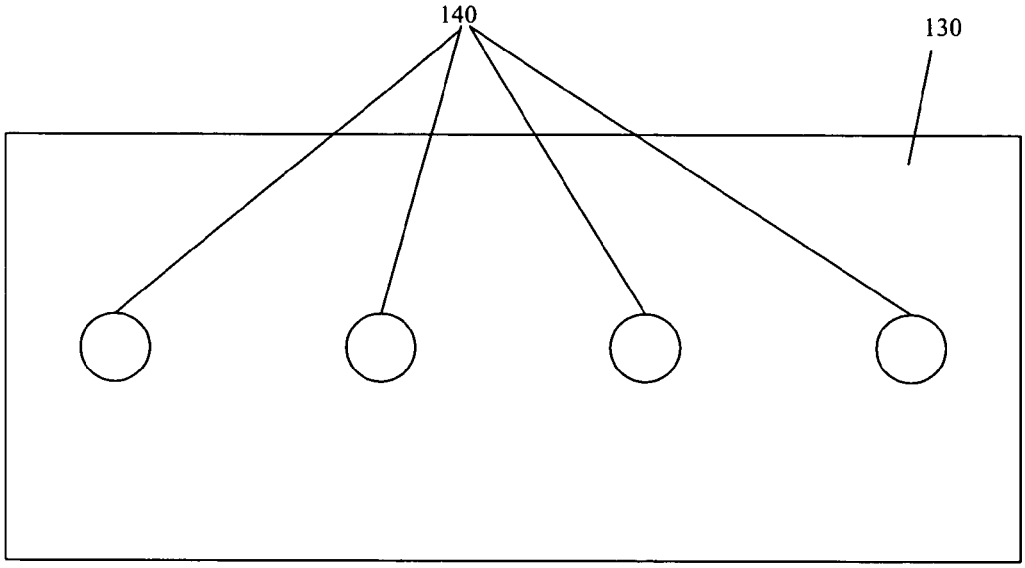

FIG. 2 illustrates a process 100 that uses the tape 20 (FIG. 1) for ensuring that tape is not trapped by rivets prior to painting. At a block 104, rivets 140 are inserted into place between two or more parts 130 and 132 of a section of an aircraft using any acceptable, known riveting method (FIG. 3). At a block 106, soluble rivet tape 20 is applied over the heads of the inserted rivets 140 (FIG. 4). At a block 108, the rivets are set by a riveter using any acceptable, known rivet-setting method. As shown in FIG. 5, remains of the tape 20 are caught in set rivets 140. At a block 112, the tape 20 is removed by hand. At a block 114, the riveted parts 130 and 132 are put through one or more wash cycles. The wash cycles dissolve any tape 20 that has been caught by rivets 140 (FIG. 6). It will be appreciated that the steps of the process 100 can be performed in other orders without departing from the scope of the invention.

In one embodiment the one or more wash cycles include a first wash cycle for removing a temporary protective fuselage coating by using a high-alkaline wash such as, without limitation Alkasol 27. A second wash cycle suitably uses a cold water rinse. The first or second wash cycle suitably dissolves any tape 20 trapped by rivets.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A riveting method comprising:

inserting a plurality of rivets through at least two objects;

applying a soluble rivet tape to one side of the two objects and over the placed rivets, wherein the soluble rivet tape has a soluble film and an adhesive coating;

setting the plurality of rivets;

removing the soluble rivet tape, wherein remains of the soluble rivet tape are entrapped in the set rivets; and applying a fluid to the set rivets, thereby dissolving any remaining rivet tape, to avoid any paint defect problems that result from a painted-over, entrapped rivet tape.

2. The method of claim 1, wherein the soluble film comprises an alkaline-soluble film.

3. The method of claim 1, wherein the soluble film comprises a water-soluble film.

4. The method of claim 1, wherein the soluble film comprises polyvinyl film.

5. The method of claim 1, wherein the at least two objects include aircraft skin.

6. The method of claim 1, wherein the adhesive coating comprises a rubber based coating.

7. The method of claim 1, wherein the adhesive coating comprises an acrylic-based coating.

8. A method of riveting aircraft parts, the method comprising:

inserting a plurality of rivets through at least two aircraft parts;

applying a soluble rivet tape over the placed rivets, wherein the soluble rivet tape has a soluble film and an adhesive coating;

setting the plurality of rivets;

removing the soluble rivet tape, wherein remains of the soluble rivet tape are entrapped in the set rivets; and applying a fluid to the at least two aircraft parts and the set rivets, thereby dissolving any remaining rivet tape, to avoid any paint defect problems that result from a painted-over, entrapped rivet tape.

9. The method of claim 8, wherein the soluble film comprises an alkaline-soluble film.

10. The method of claim 8, wherein the soluble film comprises a water-soluble film.

11. The method of claim 8, wherein the soluble film comprises a polyvinyl film.

12. The method of claim 8, wherein the adhesive coating comprises a rubber base coating.

13. The method of claim 8, wherein the adhesive coating comprises an acrylic-based coating.

* * * * *